US009997065B2

(12) United States Patent
Benner

(10) Patent No.: US 9,997,065 B2
(45) Date of Patent: Jun. 12, 2018

(54) REMOTE CONTROL USING PASSIVE COMPONENTS

(71) Applicant: DEUTSCHE TELEKOM AG, Bonn (DE)

(72) Inventor: Alexander Benner, Gehlert (DE)

(73) Assignee: DEUTSCHE TELEKOM AG, Bonn (DE)

( * ) Notice: Subject to any disclaimer, the term of this patent is extended or adjusted under 35 U.S.C. 154(b) by 0 days. days.

(21) Appl. No.: 15/603,471

(22) Filed: May 24, 2017

(65) Prior Publication Data

US 2017/0263115 A1 Sep. 14, 2017

Related U.S. Application Data

(62) Division of application No. 14/914,277, filed as application No. PCT/EP2014/065974 on Jul. 24, 2014.

(30) Foreign Application Priority Data

Aug. 30, 2013 (DE) ..... 10 2013 109 422

(51) Int. Cl.
*G08C 17/04* (2006.01)
*G08C 17/02* (2006.01)

(52) U.S. Cl.
CPC ..... *G08C 17/04* (2013.01); *G08C 17/02* (2013.01); *G08C 2201/41* (2013.01); *G08C 2201/42* (2013.01); *G08C 2201/60* (2013.01); *G08C 2201/70* (2013.01); *G08C 2201/92* (2013.01)

(58) Field of Classification Search
CPC ..... G06K 7/0008; G06K 19/0723; G06K 19/07749; G06K 7/10366; G06K 2017/0045; G06K 19/0717; G06K 19/0724; G06K 7/10079
USPC ..... 340/12.51
See application file for complete search history.

(56) References Cited

U.S. PATENT DOCUMENTS

| | | | | |
|---|---|---|---|---|
| 7,597,250 | B2 * | 10/2009 | Finn | B60R 25/25 235/375 |
| 2006/0019776 | A1 | 1/2006 | Mower | |
| 2006/0267737 | A1 * | 11/2006 | Colby | G06K 19/0707 340/10.51 |
| 2007/0194100 | A1 | 8/2007 | Plassky et al. | |
| 2009/0231179 | A1 | 9/2009 | Bruhn | |

FOREIGN PATENT DOCUMENTS

| | | | |
|---|---|---|---|
| EP | 2073182 | A2 | 6/2009 |
| EP | 2085940 | A2 | 8/2009 |
| WO | 03042798 | A2 | 5/2003 |

OTHER PUBLICATIONS

U.S. Appl. No. 14/914,277, filed Feb. 25, 2016.

* cited by examiner

*Primary Examiner* — Mark Blouin
(74) *Attorney, Agent, or Firm* — Leydig, Voit & Mayer, Ltd.

(57) ABSTRACT

A receiver includes: a wireless local area network (WLAN) router; wherein the receiver is configured to receive data from a remote control and to generate commands to be transmitted to one or more devices via an interface of the WLAN router.

4 Claims, 4 Drawing Sheets

Schematic diagram of the structure of an RFID reader/transmitter (receiver)

RFID components in a matrix pattern, with an illustration of possible locations of the related antennae Schematic diagram of the structure of an RFID reader/transmitter (receiver)

REMOTE CONTROL USING PASSIVE COMPONENTS

CROSS-REFERENCE TO RELATED APPLICATIONS

This application is a divisional of copending U.S. application Ser. No. 14/914,277, filed on Feb. 25, 2016, which is a U.S. National Phase application under 35 U.S.C. § 371 of International Application No. PCT/EP2014/065974, filed on Jul. 24, 2014, which claims benefit to German Patent Application No. DE 10 2013 109 422.8, filed on Aug. 30, 2013. The International Application was published in German on Mar. 5, 2015 as WO 2015/028215 A1 under PCT Article 21(2). The aforementioned patent applications are hereby incorporated by reference herein in their entireties.

FIELD

The invention relates to a remote control using passive components.

The invention relates to the field of remote controls, i.e. the ability to remotely control electrical devices.

BACKGROUND

A remote control is commonly an electronic handheld device, with which devices or machines can be operated over short to mid-range distances (around 2 to 20 m). The term remote control can also be used to refer to radio control. A remote control usually needs its own power supply (battery), is often somewhat unwieldy or confusing and, most of the time, is not where you expect to find it.

SUMMARY

In an embodiment, the invention provides a receiver including a wireless local area network (WLAN) router. The receiver is configured to receive data from a remote control and to generate commands to be transmitted to one or more devices via an interface of the WLAN router.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
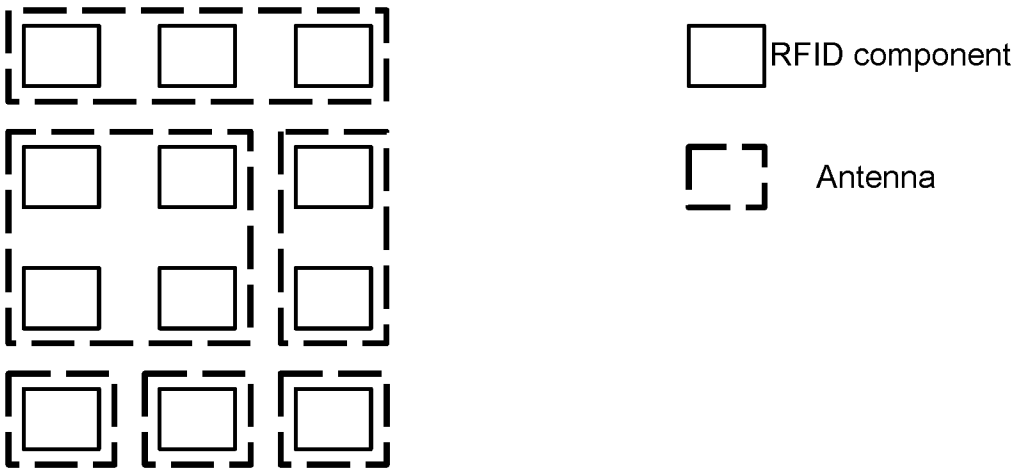
FIG. 1 shows an RFID component in a matrix pattern on a remote control, with an illustration of exemplary locations of related antennas. In this way, several components may have an antenna and/or be assigned to an antenna.

Exemplary embodiments of the invention include passive components, which do not require a permanently connected power supply, and exemplary embodiments may be only a few millimeters high (e.g. 1-2 mm) and are affixed in a desired position or already incorporated into an object (e.g. a table/desk). In an alternative embodiment, this may involve active transponders.

In a preferred embodiment, the controls are arranged in a matrix pattern and are coupled with a contactless keypad and/or a contactless freely definable input device ("remote control"). In this case, each button on the remote control includes an independently switchable RFID (radio frequency identification) transponder, for example.

The controls may themselves be cuttable and printable, enabling every user to configure their own individual "passive remote control", for example. A standard printer can be used to print out a keypad template or a membrane, which is attached to the keypad template. The printed keypad template and/or the keypad template with an attached membrane can then be trimmed to suit individual requirements using standard scissors or a paper cutter.

Finished keypads can also be ordered via the internet, from special websites allowing users to stipulate their requirements in terms of keypad lettering and size, for example. Similar to the way in which we now compile our own photo albums using a PC, for example, remote controls can be designed to suit our own requirements and tastes and, if necessary, even already be "set up" for specific use with various terminal devices.

Set-up relates to the assignment of buttons on the remote control, e.g. with specific IR Codes, which the terminal device needs to execute a command (e.g. "TV on").

There may be an adhesive film on the back of the keypad, for example, which can be used to mount it in the desired position.

As the remote control includes a membrane, so to speak, which contains no active components (which require "maintenance", like a conventional remote control, for example, which needs its battery replacing from time to time), embodiments of the invention can be made completely watertight, meaning that even spilling a glass of water on the remote control does not cause any damage. The remote control can be easily wiped with a wet cloth. It can also be flexibly mounted, by attaching it to the round leg of a table or desk, for example.

According to the invention, the remote control includes a passive RFID transponder for technical devices, which triggers a switching contact when physically touched by a user, in order to transmit data to control the technical device. In doing so, the remote control preferably transmits to a proxy and/or an interface device, which then converts the data transmitted into commands for a device.

It should be noted that the switch is, preferably, part of the RFID transponder and can mechanically create a contact when touched, for example. As a result, this may involve a very thin flat membrane keypad, which creates a contact when pressed, meaning that the corresponding chip, which is located within the RFID transponder, is activated or supplied with power.

The power for the switchable RFID transponder is, preferably, transmitted at resonance frequencies, thereby powering the passive components. Intermediate storage of the power in the form of a capacitor is also an option. Contact results in at least a single value actuation status, determined by the switching contact, in order to generate or send the data to be transmitted.

The signal (data) is transmitted, specifically, in the form of the influence of the transmitter's electromagnetic field ("power supply") that can be interpreted by the receiver.

It is certainly possible for an RFID transponder to have several contact areas, in order to transmit different signals on the basis of different touches at different places. In this case, a transponder has several contacts and transmits different signals, depending on the contacts that have been touched. In another embodiment, a variety of transponders, each with a switching contact, are arranged in a remote control, meaning that each transponder transmits its own signal when the switching contact is touched. In this case, a variety of transponders are included, each of which is assigned to a switching contact within the remote control and each of which can be independently switched, in order to control a variety of functions. This means that the individual transponders can also be pressed simultaneously, in order to simultaneously transmit data.

The switching contact is, preferably, a closing contact, which either establishes a power supply when actuated and, by doing so, switches on a receiver-antenna, or initialises an internal logic of the RFID transponder, which results in data being transmitted. Each RFID component, preferably, has its own antenna or, alternatively, components are combined in groups that operate using the same antenna, but this may also have its own drawbacks.

In another embodiment, the remote control is designed as a membrane that is, preferably, flexible, self-adhesive, magnetic and/or watertight.

This means that the remote control can be created by a printing process, in which a membrane is printed. A suitable sticker or magnetic film is located on the back of the membrane, which allows it to be affixed to a substrate.

This highly flexible remote control design makes the keypad usable for people with disabilities, particularly those who are visually impaired and, preferably, each button measures 5×5 cm, for example. Other sizes and applications, e.g. attached (stuck) to a walking aid, are a possibility.

In a preferred embodiment, the transponder acquires power from an existing local wireless network, e.g. a WLAN. A WLAN is defined by the relevant standards and is frequently present throughout the entire building. In a preferred embodiment, a WLAN router is configured by an appropriate software adaptation in such a way that the data transmitted by the remote control can also be received. This often involves modifying the WLAN signal, which is transmitted by the remote control. The WLAN router recognises the data, which is transmitted by the remote control, and generates commands in order to control the corresponding devices. These commands can be transmitted via different interfaces, e.g. infrared, Bluetooth, WLAN or ethernet/LAN. In a corresponding table, which is managed by the router, commands can be assigned to the data that is transmitted by the transponder. Using an appropriate user interface for the WLAN router (web interface), the remote control data is then assigned, optionally in the form of a specific code, to the command and/or instruction that needs to be executed in order to control a device. As a result, in this table, for example, the transponder's data can be linked with data (a command) that should be transmitted via an infrared interface, in order to switch on a television, for example. In a possible embodiment, these commands can also be learned by the original remote control for the television; a variety of these learning remote controls are known. In an alternative embodiment, the commands for individual devices can be downloaded from an internet server, where these are provided by the device manufacturer, for example, in order to be subsequently inserted into the table.

In a possible embodiment, the receiver has the functionality of a WLAN router or access point (referred to hereinafter generally as a WLAN router), which is also able to receive the remote control's data, in order to subsequently generate commands, in order for these to be transmitted to devices via the WLAN router's interface. In this case, a WLAN router is a device, which is connected, on one side, to WLAN terminal devices, in order to transmit their data via a network. This additional network may, in turn, also be a WLAN, ethernet or, for example, a DSL network, a power grid, a public cabled network or a wireless network, e.g. GSM, UMTS, LTE. This kind of WLAN router is also assigned the function of a receiver for the remote control. The router's WLAN unit is used, on the one hand, to supply the transponder with power and, on the other hand, to receive the transponder's data, in order to process it.

In another embodiment (repeater-remote), there is a separate receiver for the remote control, which includes a wireless transmitter, which transmits power for the remote control and/or the transponder. In addition, the receiver for the remote control includes an initial radio receiver for the data from the remote control and a second transmitter, which transmits the data from the remote control to the device. However, before the data is transmitted, it is processed by a processing unit, which is designed to process data from the remote control, in order to transmit it to the device via the second transmitter.

As explained previously, these signals can be transmitted to devices as an IR signal (infrared and/or optical), a Bluetooth signal or an IP signal via the second transmitter.

This has a number of advantages, including the fact that no integrated power supply (e.g. a battery) is needed for the remote control, as switchable passive RFID transponders are used.

There are also no maintenance costs for the keypad, as there are no active components and only a very limited number of moving parts are used (the thickness of the keypad is essentially determined by the height of the perceptible pressure point for switching the RF transponder).

The keypad can be made watertight, washable and for flexible use, e.g. for uneven or bent/curved substrates.

Simple and extremely cost-effective production of the keypad using a suitable on-site printing process, e.g. a special 3D printer, or finishing on the basis of prefabricated RFID media printed using a standard printer, or even using a mail order service, is an option, and may work in a similar way to an internet "photo service". At the core of the remote control are prefabricated switchable RF transponders combined in arrays, which can be produced inexpensively.

The invention can be used with existing WLAN routers/access points for implementation. In this case, for terminal devices that are controllable via the web and/or an app, only a thin adhesive keypad is needed.

The necessary functionalities can potentially be added to existing routers/access points via a software update and new routers/access points can be created at no additional cost.

For use via a "repeater-remote", completely independent operation of technology already in place at the particular location, or even technology that is not in place (e.g. networks, Internet, WLAN) is possible. The "repeater-remote" is able to directly control each terminal device, which can already be operated using a remote control.

Using a web frontend/app, the assignment of transponder signals to a concrete function (e.g. "TV on") can be altered quickly at any time and even added to, and macros can also be implemented e.g. in "TV on"+"amplifier on".

The remote control may also be used by people with physical impairments. Keypads may be produced with almost any size buttons, e.g. 5×5 cm for those with serious visual impairments.

In a preferred embodiment, one or more RFID components, mainly in a matrix pattern, are arranged on the remote control. RFID is understood to mean a transponder, which transmits data (signals). It is also necessary to have a receiver, which is able to receive and interpret signals.

Compared to the conventional use of RFID, there is a major difference in that, when inactive, i.e. not actuated, the contacts (RFID transponders) do not transmit a signal and that this kind of signal is only transmitted when actuated. Conversely, the opposite also applies, which means that if no data is transmitted, this is interpreted as a command. So the interruption of sending data means that a command is issued.

Consequently, this involves a switchable RFID transponder, and/or, generally, energy transmission types based on resonance frequencies, to power passive components, where, via an at least single value actuation status (switching status), the data to be transferred is generated and transmitted, specifically, in the form of the influence of at least one locally existing radio field.

The switching contact is usually a "closing contact" and either establishes the power supply when actuated (i.e. the "receiver-antenna" is closed) or initialises the internal logic of the RFID transponder (i.e. only now "may" the transponder transmit).

In this case, use is made of tried and tested "RFID" technology, in order to cost-effectively adopt existing security and production techniques.

For technical implementation of the receiver, the following general concepts are feasible, with the added option of hybrid forms:

Implementation without an auxiliary device, with an existing WLAN router and a terminal device that can be controlled via the network (LAN/WLAN), e.g. a smart TV.

Implementation with an auxiliary "repeater-remote" device, and a terminal device that can be controlled via the network (LAN/WLAN), e.g. a television.

For implementation without an auxiliary device, the power needed by the transponder is provided by the existing wireless network, e.g. a WLAN, at the point of use of the "passive remote". When a switching contact (transponder) is actuated, the signal (e.g. "TV on") is generated and transmitted to a ready-to-receive router. The router interprets the signal=>ascertains that it is the "TV on" signal=>transmits it via IP protocol to the television=>the television (smart TV) is switched on.

As, in terms of hardware, the majority of routers should be able to receive the signal, special software only needs to be implemented in order to convert the signal into a command via IP protocol and to transmit it to the device to be controlled. Modern routers from AVM, for example, already have their own menu option for home automation, which could also enable the administration of "passive remotes", which has to be implemented.

When using an auxiliary device, the necessary power (where this is not feasible on the basis of existing WLANs) is transmitted by an auxiliary module, the so-called "repeater-remote". This could be achieved, depending on the form factor, in a similar way to a plug-in power supply, i.e. it is simply plugged into an existing socket at the place where the "passive remote" is used.

"Repeater-remotes" have the following general and optional functions:

1. General: Receiving the transponder signal when a contact is touched
2. General: Converting the signal received into a command that can be interpreted by the terminal device, e.g. into an IR signal, Bluetooth signal or an IP signal (for transmission within the IP network to the receiver).
3. Optional: Web frontend/app, for arranging transponder signals into control signals that can be interpreted by the terminal device to be controlled (e.g. IR signal, Bluetooth signal or an IP signal=>"TV on".)
4. Optional: Supplying the transponder with the power needed to transmit a signal using electromagnetic waves.
5. Optional: Connecting to the existing IP network via a LAN, PowerLAN or WLAN.

Should it not be possible for the IR emitting diode incorporated into the "repeater-remote" to be "seen" by the terminal device, from the socket used, it is possible to use an auxiliary module (e.g. using an IR diode plugged into a jack socket with a 2 m cable), which is installed in such a way that there is a line of sight to the terminal device to be controlled.

During set-up, the keypad ("passive remote" transponder) buttons are assigned the commands expected by the terminal device. To do this, for the initial technical implementation, the WLAN router/access point must be switched to learning mode or, for the second technical implementation, the "repeater-remote".

To do this, the router/access point can be accessed via a web frontend/app and "readiness to learn" for the receipt of transponder signals can be activated. Following this, all the keypad buttons must be pressed briefly in a pre-planned sequence, to ensure that the transponders are known to the system. By indicating the array size, e.g. 4×8, the 32 fields are then consecutively graphically represented in the web frontend/app as to be learned and are filled via a user function and/or with user navigation.

On integration of the "repeater-remote" into the IP network via a LAN/WLAN, the transponder signals are notified in the same way as with a WLAN router.

For stand-alone operation (without using existing networks at the point of use), the "repeater-remote" establishes a WLAN connection using an ad-hoc network e.g. to a laptop or smartphone. In this case, the transponder signals are notified by a web frontend/app, in the same way as with a WLAN router.

A "passive remote" remote control can be created using a service provided on the internet, for example, meaning that not only are automatic labelling and possible design requirements fulfilled, but also that direct assignment between the "passive remote" (i.e. the transponder signals used in conjunction with their assignment) and the terminal device to be controlled is established. In this case, set-up would be extremely convenient, as only one identity marker would be needed to activate the passive remote. The identity marker could be a QR code, bar code or serial number printed on the remote control or its packaging. All the data required for control could then be provided via the internet and only a small number of keys (i.e. RFID transponders) could be used to check operability.

If a user acquires a new terminal device or wants to control other terminal devices, existing assignments may be amended via the web frontend/app. If a "passive remote" is integrated into the IP network, any desired operations can be controlled by it. In addition to controlling HiFi/TV terminal devices, any IP-enabled actuators, e.g. for switching house lights on and off or opening the house door, can be controlled if someone has called these previously.

Macros could even be run by pressing a button, such as, e.g., 1. Switch the TV on, 2. Switch the amplifier on, 3. Switch the room lighting off.

In principle, the implementation of a "passive remote" would also work using a switchable RFID transponder. However, this kind of implementation should really only be envisaged in exceptional cases, as this implementation is extremely prone to error, meaning that, e.g. it is only possible to clearly identify, to a very limited extent, whether a button (RFID transponder) has been deliberately switched off, is faulty or simply can no longer "merely" be received momentarily.

FIG. 1 shows an RFID component with a matrix pattern on a remote control, with an illustration of exemplary locations of the related antennas. In this way, several components may have an antenna and/or be assigned to an antenna.

Figure 2:
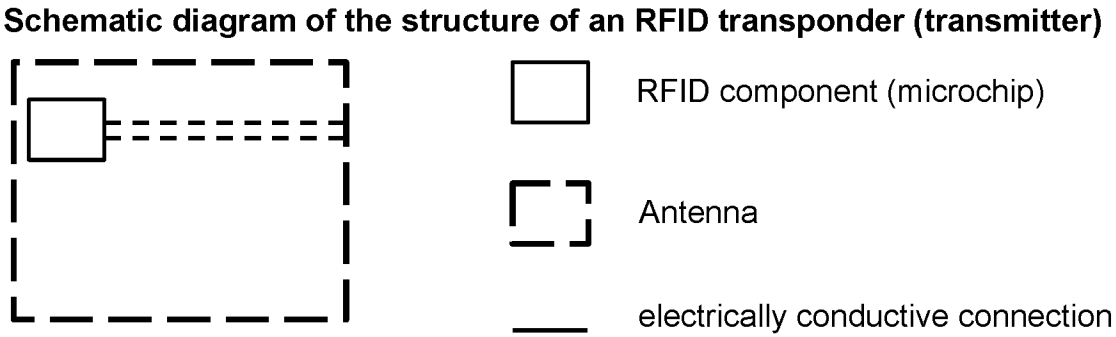
FIG. 2 shows a schematic diagram of the structure of an RFID transponder (transmitter), including a microchip, an antenna and electrically conductive connections.

FIG. 2 shows a schematic diagram of the structure of an RFID transponder (transmitter), including a microchip, an antenna and electrically conductive connections. If one has not been already incorporated into the microchip housing, a capacitor may be used, as a separate optional component, to enhance the transmitter's range and/or the response time from activation of the button to the transmission of data.

Figure 3:
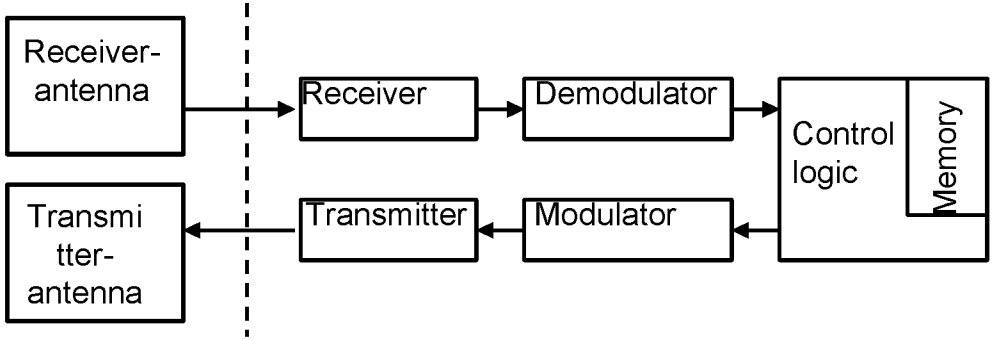
FIG. 3 shows a schematic diagram of the structure of an RFID component (microchip), where the antenna is responsible for receiving and transmitting signals, as well as the "power supply" for the RFID component, which is generally the same component (hardware).

FIG. 3 shows a schematic diagram of the structure of an RFID component (microchip), where the antenna is responsible for receiving and transmitting signals, as well as the "power supply" for the RFID component, which is generally the same component (hardware). The reception route with an antenna, receiver and demodulator is shown as an option, in the simplest form of implementation, the receiver antenna is only needed to supply power.

For more complex applications, a specific "function signal" can be received and decoded, in the context of which, only the signal transmitted when the contact is touched can be transmitted, e.g. phased. Security functions are also a possibility, meaning that, e.g., the RFID transponder only discloses its "secret" (data), when specific data is received in the form of a function signal (password). In this way, highly secure remote controls, which are only usable in conjunction with a certain function signal, are also an option.

Figure 4:
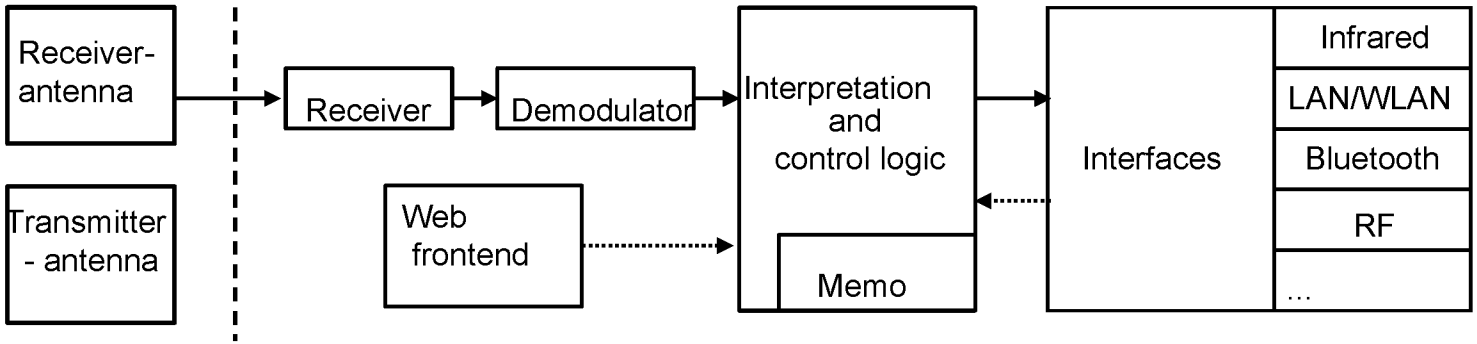
FIG. 4 shows a schematic diagram of the structure of an RFID reader/transmitter (receiver).

FIG. 4 shows a schematic diagram of the structure of an RFID reader/transmitter (receiver).

In the simplest application, the transmitter antenna is only used as a "power supply" for the RFID transponder and can be located in the same housing as the receiver or implemented on the basis of other devices.

The interfaces issue the particular control code needed for the terminal device to be controlled in a manner that can be processed by it, e.g. an infrared signal for a television.

Assignment between the "activated" RFID transponder (button) and control code for the device to be controlled (e.g. TV) is performed in two ways:

1.) Assignment between a button and a function (e.g. switch on) is established via a web frontend/app. Ideally, this is based on the prior selection of the device to be controlled from a database, which already contains the particular control codes that can be processed by the receiver, by function (e.g. switch on).

2.) In this case, the interfaces not only function as transmitters, but also as receivers for the learning process, i.e. the assignment of buttons from the new to "old" (existing) remote control. In concrete terms, this takes place as follows:

a) The interpretation and control logic is switched to the "learn" phase.

b) The assignment between the buttons and the control codes to be transmitted is created on the new and old remote control simultaneously or on the basis of a predetermined process (e.g. first press the "old" remote control button and then the "new" remote control button). A prerequisite for this is that the control code for the particular function can be correctly received via the interface. In this way, the new remote control is "learned" as regards the code to be used.

c) The "learn" phase is completed.

The assignments generated in the aforementioned manner, the interface to be used and, where applicable, specifications established regarding pre-programmed processes (macros) and other general operational settings are stored in the memory.

The web frontend provides access via http:// and/or https:// to the interpretation and control logic. It also allows direct control commands to be issued (depending on the scope of the graphical user interface), without pressing a button.

In another embodiment, a password exchange and/or a challenge-response process is in use.

It should be noted, for example, that many users have a remote control for their garage door. The "password" for opening the door includes knowing a certain code, among up to several million possible codes. However, if the remote control is left in the car, while the car is in for servicing or repair, it is any easy matter for an unauthorised person to make a duplicate of the remote control. In addition to "learnable" universal remote controls, it is also normally easy to acquire a replacement remote control and to then allow it to learn from the remote control in the car.

The inherent security mechanisms within more complex RFID transponders allow this to be prevented, i.e. the transponder only responds with the correct code if it has previously wirelessly received a certain password. In this manner, there is, to some extent, a challenge-response operation. A "complete" "Challenge→Response" operation is retained, if the integrated microcontroller supports this function as follows.

1. The wireless network transmits the password and Secret 1
2. The transponder "recognises" the password and computes Secret 2 on the basis of Secret 1
3. Secret 2 is issued, together with the code, from the transponder to the wireless network (and/or the receiver), whereby Secret 2 can also be "combined" with the code, e.g. via an XOR function.
4. The receiver compares the result for Secret 2 and the code that has been transmitted by the transponder with the result it has computed for this purpose.
5. If the two results match, a function (e.g. open door) is performed. If the results do not match, no function is performed. It should be noted that the transponder and the receiver must know the algorithm for computing Secret 2 on the basis of Secret 1 and the form of the result of the code and Secret 2. Secret 1 is transmitted by the receiver, is known to it and the transponder receives it wirelessly.

The following is an example of how this process is implemented:

the code is "1000"

Secret 1 is "1"

the algorithm for computing Secret 2 is:

Secret 2=Secret 1+"2"

=>this means that Secret 2 is "3"

the code "1000" is "combined" with Secret 2, e.g. mathematically added together ("1000"+"3")=>the transponder transmits "1003"

the receiver computes the result in an identical manner. If the two results are the same, the transponder is verified as "Genuine" and/or the "Original".

The aforementioned mechanism ensures the following:

a) Basic challenge-response operation: The "correct" code is only "transmitted" within a specific wireless network. This significantly reduces the risk of unauthorised reading of the code. However, the same code is always transmitted.

b) Complete challenge-response operation: The "correct" code is only "transmitted" within a known wireless network. However, the signal ("code") needed for an action changes constantly in a manner known only to the transponder and receiver, making it impossible for potential "intruders" to guess the code.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A receiver, comprising:

a first wireless transmitter, configured to transmit power for a remote control, wherein the remote control is a passive or active radio frequency identification (RFID) transponder;

a first receiver, configured to receive data from the remote control;

a second wireless transmitter, configured to transmit the data from the remote control to a device; and a processor, configured to process the data from the remote control to facilitate transmission of the data from the remote control to the device via the second wireless transmitter;

wherein the processor is further configured to facilitate:

transmitting a password and a first parameter to the remote control;

receiving a second parameter together with a code from the remote control;

comparing the second parameter together with the code with a computed result; and in response to the second parameter together with the code matching the computed result, performing a function.

2. The receiver according to claim 1, wherein the second wireless transmitter is configured to transmit the data from the remote control to the device as an infrared (IR) signal, a Bluetooth signal, a radiofrequency (RF) signal or an internet protocol (IP) signal.

3. The receiver according to claim 1, further comprising:

a web interface, configured to facilitate assignment of a specific function of one or more devices to a piece of remote control data;

wherein the processor is further configured to use the assignment to convert the data from the remote control into a signal for the device.

4. The receiver according to claim 1, wherein the processor is configured to facilitate assignment of one or more functions to one or more buttons of the remote control.

* * * * *